US011180944B2

(12) United States Patent
Herrmann et al.

(10) Patent No.: US 11,180,944 B2
(45) Date of Patent: Nov. 23, 2021

(54) VEHICLE DOOR ARRANGEMENT HAVING A SENSOR DEVICE FOR DETECTING A WISH FOR ADJUSTMENT

(71) Applicant: BROSE FAHRZEUGTEILE GMBH & CO. KG, Bamberg (DE)

(72) Inventors: Christian Herrmann, Grossheirath (DE); Wolfgang Uebel, Weitramsdorf (DE)

(73) Assignee: BROSE FAHRZEUGTEILE GMBH & CO. KG, BAMBERG, Bamberg (DE)

( * ) Notice: Subject to any disclaimer, the term of this patent is extended or adjusted under 35 U.S.C. 154(b) by 153 days.

(21) Appl. No.: 16/314,175

(22) PCT Filed: Jun. 28, 2017

(86) PCT No.: PCT/EP2017/066029
§ 371 (c)(1),
(2) Date: Dec. 28, 2018

(87) PCT Pub. No.: WO2018/002158
PCT Pub. Date: Jan. 4, 2018

(65) Prior Publication Data

US 2019/0234129 A1 Aug. 1, 2019

(30) Foreign Application Priority Data

Jun. 29, 2016 (DE) ..... 102016211777.7

(51) Int. Cl.
*E05F 15/627* (2015.01)
*E05F 15/611* (2015.01)
(Continued)

(52) U.S. Cl.
CPC ..... *E05F 15/627* (2015.01); *E05F 15/41* (2015.01); *E05F 15/611* (2015.01); *E05F 15/75* (2015.01);
(Continued)

(58) Field of Classification Search
CPC ..... E05F 15/75
See application file for complete search history.

(56) References Cited

U.S. PATENT DOCUMENTS 6,145,917 A * 11/2000 Ishii ..... E05F 1/1091 296/146.1
6,877,791 B2 * 4/2005 Greuel ..... E05F 15/622 296/146.1
(Continued)

FOREIGN PATENT DOCUMENTS

CN 1928308 A 3/2007
CN 104812985 A 7/2015
(Continued)

*Primary Examiner* — Catherine A Kelly
(74) *Attorney, Agent, or Firm* — Brooks Kushman P.C.

(57) ABSTRACT

A vehicle door assembly including a vehicle door pivotally arranged on a vehicle body, a force-transmitting device for adjusting and/or fixing the vehicle door relative to the vehicle body, wherein the force-transmitting device includes a transmission element for producing a flux of force between the vehicle door and the vehicle body in order to adjust the vehicle door relative to the vehicle body or hold it in position relative to the vehicle body, and a control device for controlling the force-transmitting device. In addition, there is provided a sensor device in the form of an acceleration sensor arranged on the vehicle door for measuring the acceleration of the vehicle door, or a gyrosensor arranged on the vehicle door for measuring the angular velocity of the vehicle door, or a force sensor arranged in the flux of force between the vehicle door and the vehicle body.

12 Claims, 8 Drawing Sheets

(51) Int. Cl.
*E05F 15/41* (2015.01)
*E05F 15/75* (2015.01)

(52) U.S. Cl.
CPC ... *E05Y 2201/216* (2013.01); *E05Y 2201/654* (2013.01); *E05Y 2400/44* (2013.01); *E05Y 2400/452* (2013.01); *E05Y 2800/11* (2013.01); *E05Y 2800/113* (2013.01); *E05Y 2900/531* (2013.01)

(56) References Cited

U.S. PATENT DOCUMENTS

| | | | | |
|---|---|---|---|---|
| 7,866,728 | B2 | 1/2011 | Suzuki | |
| 8,508,159 | B2 | 8/2013 | Herrmann et al. | |
| 9,777,528 | B2 * | 10/2017 | Elie | E05F 15/46 |
| 9,868,340 | B2 * | 1/2018 | Nishikibe | E05F 1/002 |
| 10,017,976 | B2 * | 7/2018 | Herrmann | E05F 15/40 |
| 10,132,112 | B2 * | 11/2018 | Yu | E05F 15/76 |
| 10,538,951 | B2 * | 1/2020 | Herrmann | E05F 15/70 |
| 10,570,656 | B2 * | 2/2020 | Elie | E05F 15/40 |
| 10,626,659 | B2 * | 4/2020 | Herrmann | E05F 15/616 |
| 2005/0217075 | A1 * | 10/2005 | Enomoto | E05F 15/63 16/285 |
| 2014/0303852 | A1 * | 10/2014 | Seki | E05F 15/40 701/49 |
| 2019/0203517 | A1 * | 7/2019 | Herrmann | E05F 15/627 |

FOREIGN PATENT DOCUMENTS

| | | | |
|---|---|---|---|
| DE | 10313440 | A1 | 10/2004 |
| DE | 102008064570 | A1 | 6/2010 |
| DE | 102009000021 | A1 | 7/2010 |
| WO | 02084061 | A1 | 10/2002 |

* cited by examiner

VEHICLE DOOR ARRANGEMENT HAVING A SENSOR DEVICE FOR DETECTING A WISH FOR ADJUSTMENT

CROSS-REFERENCE TO A RELATED APPLICATIONS

This application is the U.S. National Phase of PCT Application No. PCT/EP2017/066029, filed on Jun. 28, 2017, which claims priority to German Patent Application No. DE 10 2016 211 777.7, filed on Jun. 29, 2016, the disclosures of which are incorporated in their entirety by reference herein.

TECHNICAL FIELD

The present disclosure relates to a vehicle door assembly.

BACKGROUND

A vehicle door assembly may include a vehicle door pivotally arranged on a vehicle body and a force-transmitting device for adjusting and/or fixing the vehicle door relative to the vehicle body. The force-transmitting device includes a transmission element for producing a flux of force between the vehicle door and the vehicle body in order to adjust the vehicle door relative to the vehicle body or hold it in position relative to the vehicle body. A control device serves for controlling the force-transmitting device.

The vehicle door may be a vehicle side door or also a liftgate. In this connection, vehicle door is understood to be any flap of a vehicle which in the closed position closes a vehicle opening.

The force-transmitting device can be configured as an adjusting device and/or as a fixing device and correspondingly serve for adjusting the vehicle door or for fixing the vehicle door in a position just taken. When the force-transmitting device is configured as an adjusting device it includes a driving device in the form of a drive motor to adjust the vehicle door electromotively. A fixing device on the other hand can also be used independent of an electromotive adjusting device in order to fix a vehicle door in an open position and thus hold it in position so that the vehicle door cannot easily slam shut from the open position, in any case not in an uncontrolled way.

SUMMARY

The present disclosure may provide one or more proposed solutions to provide a vehicle door assembly which in a simple way provides for a reliable recognition of a user's wish for adjustment.

Accordingly, the vehicle door assembly may include a sensor device in the form of an acceleration sensor arranged on the vehicle door for measuring the acceleration of the vehicle door, or a gyrosensor arranged on the vehicle door for measuring the angular velocity of the vehicle door, or a force sensor arranged in the flux of force between the vehicle door and the vehicle body, wherein the control device is configured to evaluate a sensor signal of the sensor device for recognizing a user's wish for adjustment and actuate the force-transmitting device in dependence on the evaluation for an adjustment of the vehicle door.

The present disclosure proceeds from the idea to use a sensor device that can issue a sensor signal that can indicate a movement or a force on the vehicle door with comparatively little delay and great accuracy. Such a sensor device can thus be used for initiating an adjusting operation, for example for closing the vehicle door from an open position, by evaluating the sensor signal in order to recognize with reference to the sensor signal that a user touches the vehicle door and thereby signals that the vehicle door shall be adjusted.

Adjusting the vehicle door after recognition of a user's wish for adjustment in principle can be affected electromotively or manually, depending on the configuration of the force-transmitting device. In the first case, the force-transmitting device includes a drive motor that is coupled to the transmission element of the force-transmitting device and can be actuated in order to move the vehicle door upon recognition of a wish for adjustment. When it is recognized for example that a user pushes the vehicle door in order to close the same, this can be recognized correspondingly by using the at least one sensor device in order to actuate the drive motor for electromotively closing the vehicle door when a wish for adjustment has been recognized. In the second case, the force-transmitting device is configured for example as (pure) fixing device that fixes the vehicle door in a position just taken (open position). When a user's wish for adjustment is recognized with such a force-transmitting device, the force-transmitting device is actuated by the control device in order to enable an adjustment of the vehicle door so that a user can manually move the vehicle door out of the position just taken.

In one embodiment, the sensor device is configured as an acceleration sensor for measuring the acceleration of the vehicle door. Such an acceleration sensor for example can be constructed as a piezoelectric sensor or as a so-called MEMS sensor (MEMS: Microelectromechanical System). Such an acceleration sensor can measure accelerations in a two-dimensional plane or also in the three-dimensional space.

In another embodiment, the sensor device can be configured as a so-called gyrosensor. Such a gyrosensor, also referred to as gyrometer, measures a rotary movement, i.e. in the case of the vehicle door the swivel movement about the swivel axis about which the vehicle door is pivotable relative to the vehicle body.

In yet another embodiment, the sensor device also can be formed by a force sensor arranged in the flux of force between the vehicle door and the vehicle body. The force sensor here is disposed in the flux of force for example before the drive motor so that the sensor signal of the force sensor can indicate the action of a force in the power transmission train between the vehicle door and the vehicle body with little time delay.

The recognition of a user's wish for adjustment is effected by evaluation of the sensor signal of the at least one sensor device. Depending on the configuration of the sensor device, the sensor signal indicates an acceleration, movement or force on the vehicle door, of which it is assumed that it results from a user touching the vehicle door for adjusting the vehicle door. When the sensor signal indicating the acceleration, the movement or the force exceeds a predetermined threshold value or when the sensor signal resembles a particular time profile, it is concluded therefrom that a user's wish for adjustment is present, and the control device correspondingly actuates the force-transmitting device in order to initiate an electromotive adjustment or to enable a manual adjustment.

By specifying the threshold value the sensitivity of the recognition can be set. By specifying the threshold value it is possible for example to set the force required for initiating or enabling an adjusting operation, which force may be applied by a user.

The sensor signal of the sensor device may be evaluated solely for recognizing a user's wish for adjustment. Solely with reference to the sensor signal that is provided by the sensor device can a wish for adjustment be inferred, in that for example with reference to an acceleration or an action of force on the vehicle door it is inferred whether (with high probability) a user wants to adjust the vehicle door by manually touching the vehicle door.

However, it is also conceivable and possible to additionally take account of other signals for example of other sensor devices in order to identify a user's wish for adjustment, or to evaluate signals of an acceleration sensor, a gyrosensor and/or a force sensor in combination so that an acceleration sensor, a gyrosensor and a force sensor can also be present in combination.

In a concrete embodiment, the vehicle door assembly can include an electrically actuatable coupling device which in a coupling, first condition couples the drive motor to the transmission element in order to exert an adjusting force for adjusting the vehicle door on the transmission element. In a decoupling, second condition the coupling device on the other hand decouples the drive motor from the transmission element so that the vehicle door for example can be manually adjusted independent of an actuation of the drive motor. Via the coupling device, the flux of force between the vehicle door and the vehicle body thus can be eliminated so that an adjustment of the vehicle door independent of an actuation of the drive motor, for example manually by a user, is possible.

The coupling device in particular is configured to fix the vehicle door in a holding position of the vehicle door due to the fact that it is disposed in the coupling, first condition. Because the coupling device is in its coupling, first condition, the force transmission train between the vehicle body and the vehicle door is closed so that in the holding position the vehicle door is held in position relative to the vehicle body.

When a user's wish for adjustment is recognized, for example when a user pushes the vehicle door in order to adjust the same, the control device in one embodiment can actuate the coupling device in order to transfer the coupling device from the coupling, first condition into the decoupling, second condition so that the force transmission train between the vehicle body and the vehicle door is separated and the vehicle door thus can be freely adjusted relative to the vehicle body. In this way, a manual adjustment of the vehicle door is enabled so that the user for example can close or further open the vehicle door.

In one embodiment, the force-transmitting device includes a drive motor for electromotively adjusting the vehicle door. The force-transmitting device thus can be used for electromotively adjusting the vehicle door, wherein in addition a coupling device can be present, which by decoupling can also enable a manual adjustment of the vehicle door.

When a user's wish for adjustment is recognized in such an electromotively drivable force-transmitting device, the control device can be configured to actuate the drive motor for electromotively adjusting the vehicle door. When a wish for adjustment is recognized, the adjustment thus is effected electromotively, for example in dependence on a recognized direction of a wish for adjustment (in the direction of closing or in the direction of (further) opening the vehicle door).

In one embodiment, the drive motor can be stationarily arranged on the vehicle door. In this case, the transmission element can be formed for example as a so-called catch strap and be articulated to the vehicle body. For adjusting the vehicle door, the drive motor acts on the transmission element and adjusts the same so that via the transmission element a relative movement between the vehicle door and the vehicle body can be effected.

In principle, different embodiments are conceivable and possible for coupling the drive motor to the transmission element. For example, the drive motor can engage into a toothing of the transmission element via a pinion in order to adjust the transmission element by rotating the pinion. When the drive motor is stationarily arranged on the vehicle door and the transmission element is articulated to the vehicle body, the vehicle door is pivoted relative to the vehicle body by adjusting the transmission element relative to the drive motor.

In another embodiment, the drive motor can be coupled to the transmission element for example via a cable drive. For this purpose, a shaft drivable by the drive motor can be coupled to the transmission element via a flexible coupling element formed for the transmission of tensile forces—such as a traction cable, a ribbon, a strap or a belt. The coupling element for example can be attached to the transmission element with two ends and be placed around a roller element arranged on the shaft, for example around a cable drum, so that by rotating the roller element the coupling element rolls off on the roller element and the transmission element thereby is adjusted relative to the drive motor.

A sensor device in the form of a force sensor be arranged for can example on the transmission element and serve for measuring a force on the coupling element. For example, a sensor device in the form of a force sensor can be arranged on a tensioning device for tensioning the coupling element relative to the transmission element. Via the tensioning device an end of the coupling element can be fixed to the transmission element, wherein the tensile stress in the coupling element can be set via the tensioning device. A user's wish for adjustment, which the same expresses by touching the vehicle door and for example by pushing the vehicle door, results in a force acting on the coupling element which, however, is recognized by the force sensor and can be utilized for recognizing the wish for adjustment.

In another embodiment, a sensor device in the form of a force sensor can also be configured to measure a torsion of the shaft. Such a sensor device can be designed for example as a contactless, inductive or capacitive sensor to measure the position of an eccentric disk on the shaft. When it is detected via the sensor that a torsion occurs on the shaft, the force acting on the shaft in the flux of force may be inferred therefrom.

In yet another embodiment, a sensor device in the form of a force sensor can be formed by a magnetic field sensor for measuring a magnetic field on the shaft or a part connected to the shaft. In this case, the shaft for example can include one or more magnetic portions, for example in the form of discrete magnetic elements attached to the shaft or in the form of magnetized portions (tracks) of the shaft. In this case, a magnetic field is obtained at the shaft, which is variable in dependence on a torsion of the shaft. By using a magnetic field sensor, which for example is arranged on a stationary portion of the force-transmitting device and thus is not moved along with a torsion of the shaft, a change in the magnetic field at the shaft can be detected in order to infer a torsion of the shaft in dependence on such a detection.

The at least one magnetic portion for example extends along the shaft. The magnetic sensor may extend entirely or partly around the shaft. For example, the magnetic field sensor can have a semicircular shape and thus extend halfway around the shaft in the form of a half-ring to detect a change in the magnetic field at the shaft.

When the vehicle door is fixed, the torsion of the shaft is directly proportional to the torque acting on the shaft, which in turn is affected by the action of a force on the vehicle door. From the torsion of the shaft, the force applied to the vehicle door can thus be inferred directly, which force can be produced by a user touching, for example pushing the vehicle door, and thus indicates a user's wish for adjustment. The force acting on the vehicle door thus can be calculated from the torsion in order to recognize a user's wish for adjustment.

Alternatively or in addition, a sensor device in the form of a force sensor can also be arranged on a stationary portion of the force-transmitting device, for example on mount of the force-transmitting device via which the force-transmitting device is fixed to the vehicle door, and measure a deformation of the stationary portion. Such a sensor device can be configured for example by an inductive sensor or by a piezosensor, which are formed to measure a relative movement of the stationary portion of the force-transmitting device for example relative to a stationary portion of the vehicle door, in order to therefrom infer a deformation at the stationary portion of the force-transmitting device. When the vehicle door is in the holding position, the deformation of the stationary portion results from the action of a force on the vehicle door, so that a user's wish for adjustment, which the same expresses by action of a force on the vehicle door, can be inferred from a deformation of the stationary portion detected via the sensor device.

An inductive sensor can measure for example a distance between the stationary portion of the force-transmitting device and a stationary portion of the vehicle door. When changes in distance are obtained, a deformation of the stationary portion of the force-transmitting device can be inferred therefrom.

A piezosensor on the other hand can be arranged for example between the stationary portion of the force-transmitting device and the stationary portion of the vehicle door and be connected to both stationary portions in order to pick up a relative movement between the stationary portion of the force-transmitting device and the stationary portion of the vehicle door and therefrom infer a deformation of the stationary portion of the force-transmitting device relative to the stationary portion of the vehicle door.

When the sensor device is configured as an acceleration sensor or as a gyrosensor, this sensor device in the form of the acceleration sensor or the gyrosensor can be arranged for example on a door module of the vehicle door or be integrated into the control device stationarily arranged on the vehicle door. In the first case, the sensor device can be configured for example as a separate component and be arranged on an assembly carrier of the door module. In the second case, the sensor device for example is integrated into the control device and thus is arranged for example in the same housing as a circuit board of the control device, possibly even on the circuit board of the control device. The control device can likewise be arranged on an assembly carrier of the door module. In both cases, the sensor device in the form of the acceleration sensor or the gyrosensor is stationarily arranged on the vehicle door and thus is moved together with the same during an acceleration at the vehicle door. With reference to a sensor signal of the sensor device indicating the acceleration of the vehicle door or the swivel movement of the vehicle door the movement of the vehicle door and hence a user's wish for adjustment can thus be inferred directly.

The sensor device can also be used to wake up the control device and/or the force-transmitting device from a so-called sleep mode. When the vehicle door firmly is in an open position for an extended period, the control device can independently be switched into the sleep mode for energy saving purposes, in which sleep mode the functionality of the control device is reduced so that the control device only has a reduced energy consumption. When the sensor device detects a movement or force at the vehicle door, for example due to a user's wish for adjustment, which the same expresses by touching the vehicle door, the control device can be waked up from the sleep mode by a correspondingly generated sensor signal of the sensor device and be transferred into a full operating condition. Thus, the sensor signal of the sensor device in this case also serves to influence the operating condition of the control device.

BRIEF DESCRIPTION OF THE DRAWINGS

The embodiments will be explained in detail below with reference to the exemplary embodiments illustrated in the Figures.

DETAILED DESCRIPTION

When a vehicle door is open and when it is kept in the open position via the force-transmitting device, it may be desirable that a user intuitively can initiate a movement of the vehicle door out of the open position, for example for closing the vehicle door or for further opening the vehicle door. It may be required that a user's wish for adjustment, who for example touches the vehicle door in order to adjust the vehicle door, may be recognized correspondingly in order to actuate the force-transmitting device in dependence on the recognition of such a wish for adjustment and correspondingly provide for an adjusting operation of the vehicle door, by manual adjustment or by electromotive adjustment.

Figure 1:
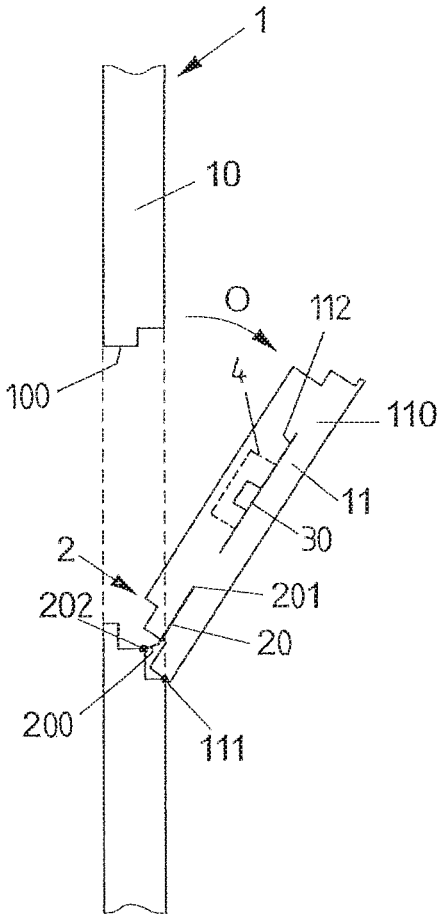
FIG. 1 shows a schematic view of an adjustment element in the form of a vehicle door on a stationary portion in the form of a vehicle body.

FIG. 1 shows a schematic view of a vehicle 1 that includes a vehicle body 10 and an adjustment element in the form of a vehicle door 11, which is arranged on the vehicle body 10 via a joint 111 and is pivotable about a swivel axis along an opening direction θ.

The vehicle door 11 can be realized for example by a vehicle side door or also by a liftgate. In a closed position the vehicle door 11 covers a vehicle opening 100 in the vehicle body 10, for example a side door opening or a liftgate opening.

Via a force-transmitting device 2 arranged in a door interior space 110, the vehicle door 11 is electromotively movable from its closed position into an open position, so that the vehicle door 11 can automatically be moved in an electromotive way. The force-transmitting device 2, schematically illustrated in FIG. 2 and in an exemplary embodiment shown in FIGS. 3 to 5, includes a drive motor 22 which via a coupling device 21 is coupled to a transmission element 20, that may transmit adjusting forces between the vehicle door 11 and the vehicle body 10. In this exemplary embodiment the drive motor 22 is stationarily arranged on the vehicle door 11, while the transmission element 20 in the manner of a so-called catch strap is articulated to an end 200 and thus pivotally fixed to the vehicle body 10.

In the exemplary embodiments of the force-transmitting device 2 as shown in FIGS. 2 and 3 to 5 the drive motor 22 serves for driving a drive element 23 in the form of a cable drum, which via a coupling element 24 in the form of a flexible, slack pulling element, in particular in the form of a traction cable (for example a steel cable) formed to transmit (exclusively) tensile forces, is coupled to the transmission element 20. The cable drum 23 for example can be supported on the longitudinally extending transmission element 20 and roll off on the transmission element 20.

The coupling element 24 is connected to the transmission element 20 via a first end 240 in the region of the end 200 of the transmission element 20 and via a second end 241 in the region of a second end 201 and slung around the drive element 23 in the form of the cable drum. When the drive element 23, driven by the drive motor 22, is put into a rotary movement, the coupling element 24 in the form of the pulling element (traction cable) rolls off on the drive element 23, so that the drive element 23 is moved relative to the transmission element 20 and thus along the longitudinal direction of the transmission element 20 relative to the transmission element 20, which leads to an adjustment of the vehicle door 11 relative to the vehicle body 10.

It should be noted at this point that other construction forms of force-transmitting devices also are conceivable and possible. For example, the drive motor 22 also can drive a pinion that is in meshing engagement with the transmission element 20. It is also conceivable and possible that the force-transmitting device is configured as a spindle drive for example with a rotatable spindle that is in engagement with a spindle nut.

The coupling device 21 serves to couple the drive motor 22 to the drive element 23 or to decouple the same from the drive element 23. In a coupling condition the coupling device 21 produces a flux of force between the drive motor 22 and the drive element 23, so that a rotary movement of a motor shaft 220 of the drive motor 20 is transmitted to the drive element 23 and accordingly the drive element 23 is put into a rotary movement, in order to thereby introduce an adjusting force into the transmission element 20. In a decoupling condition, on the other hand, the drive motor 22 is decoupled from the drive element 23, so that the drive motor 22 can be moved independent of the drive element 23 and inversely the drive element 23 can be moved independent of the drive motor 22. In this decoupling condition for example a manual adjustment of the vehicle door 11 can be possible without the drive motor 22 being loaded with forces.

The coupling device 21 also can have a third coupling condition, corresponding to a slipping condition in which coupling elements slipplingly are in contact with each other. A first coupling element here is operatively connected to a motor shaft of the drive motor 22, while a second coupling element is operatively connected to the drive element 23. In this slipping, third condition the coupling device 21 for example can provide a braking force during a manual adjustment of the vehicle door 11, caused by the slipping contact of the coupling elements with each other.

Figure 3:
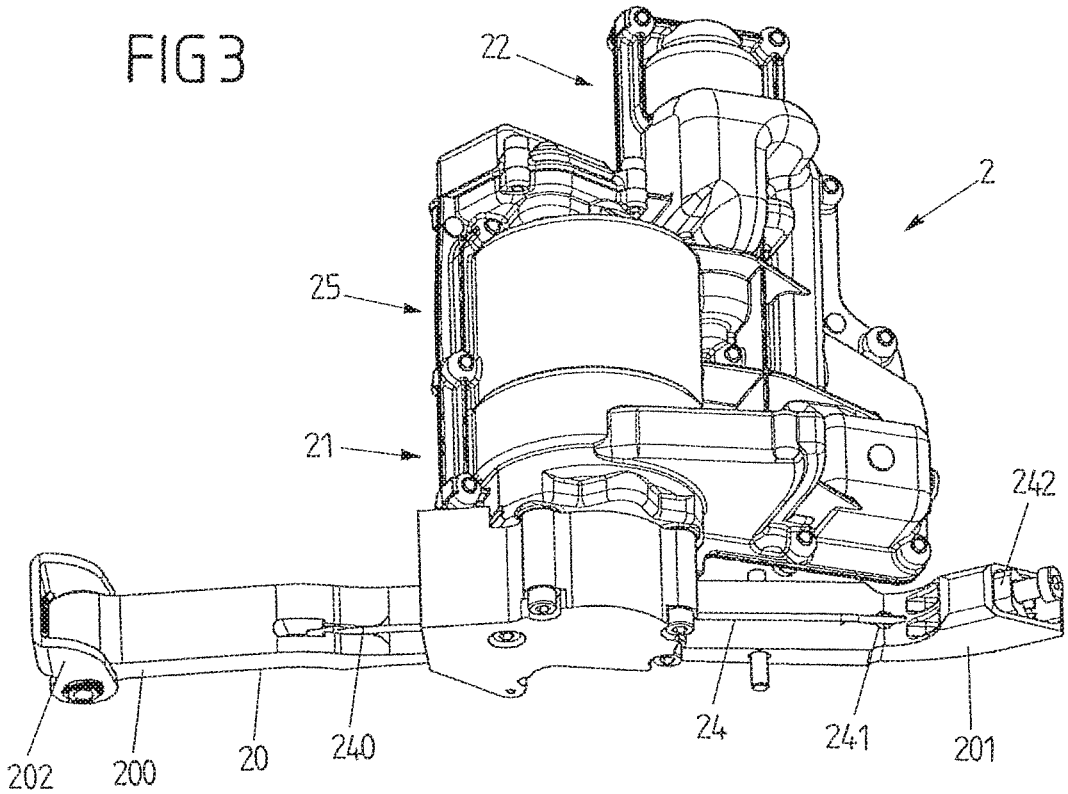
FIG. 3 shows a view of an exemplary embodiment of a force-transmitting device in the form of a door drive for adjusting a vehicle door.
Figure 4:
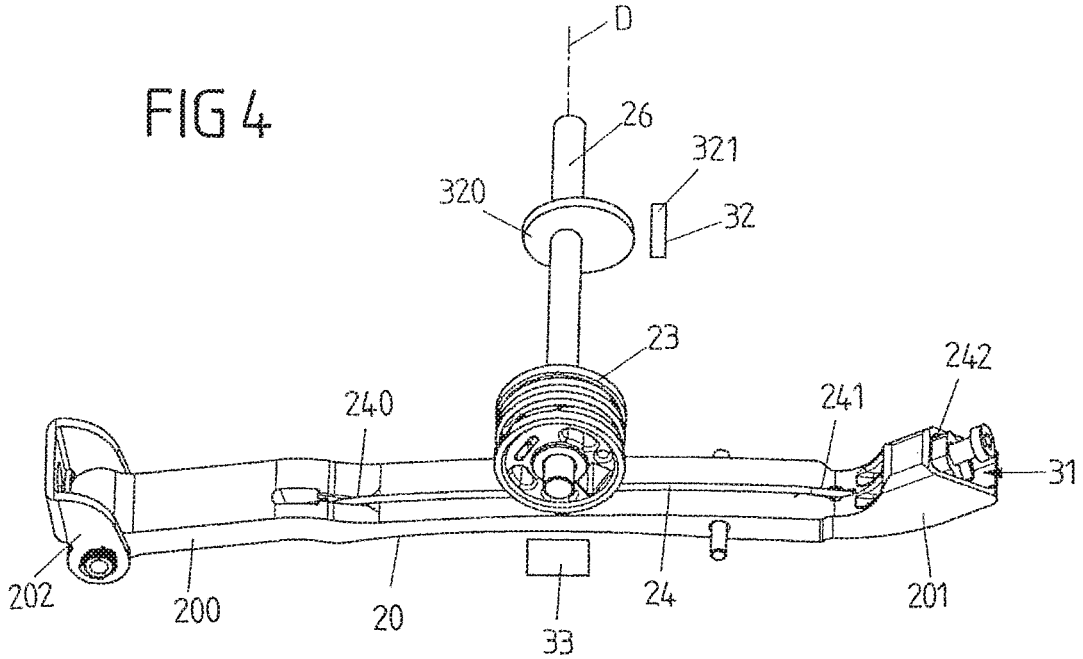
FIG. 4 shows a view of a sub-assembly of the door drive.
Figure 5:
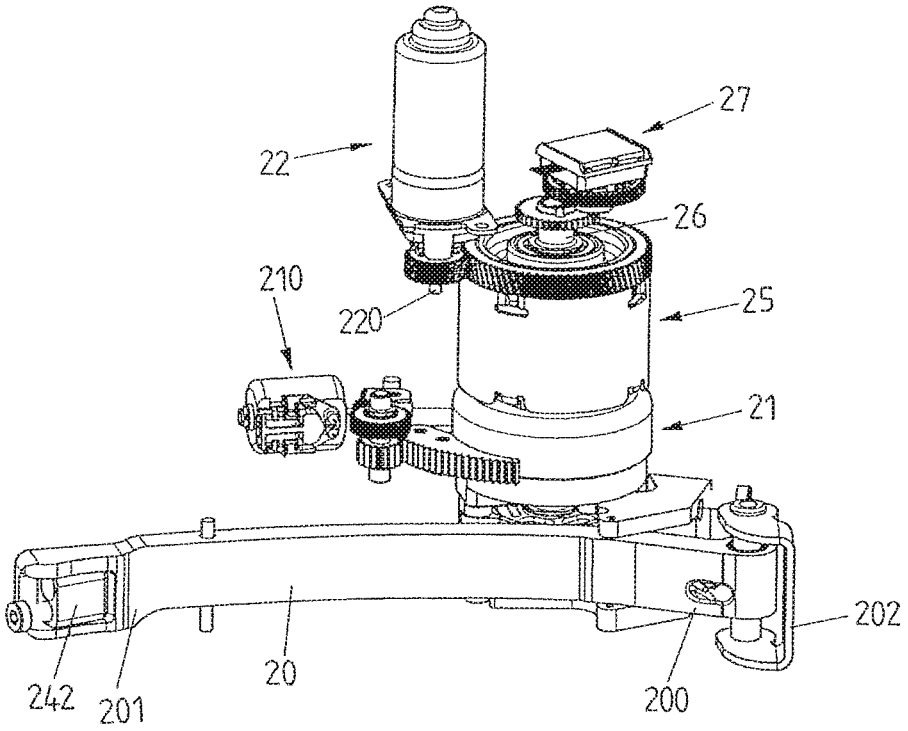
FIG. 5 shows a view of a drive motor, a transmission and a coupling device of the door drive.

In the exemplary embodiment concretely shown in FIGS. 3 to 5 the drive motor 22 includes a motor shaft 220 which in operation of the force-transmitting device 2 is put into a rotary movement and is operatively connected to a transmission 25 (for example a planetary transmission). Via the transmission 25 a shaft 26 rotatable about an axis of rotation D is driven, on which the drive element 23 in the form of the cable drum is non-rotatably arranged so that by rotating the shaft 26 the drive element 23 can be driven, the coupling element 24 in the form of the traction cable thereby rolls off on the drive element 23 and the transmission element 20 thus is adjusted for moving the vehicle door 11. Via a sensor device 27 the absolute position of the shaft 26 can be determined in operation.

In its coupling condition, the coupling device 21 electrically actuatable via an actuating drive 210 produces a flux of force between the transmission 25 and the shaft 26 so that in the coupling condition of the coupling device 21 an adjusting force can be transmitted from the drive motor 22 to the shaft 26 and thereby to the transmission element 20. In its decoupling condition, the coupling device 21 on the other hand eliminates the flux of force between the drive motor 22 and the shaft 26 so that the transmission element 20 can be adjusted relative to the drive motor 22 without a force being applied onto the drive motor 22.

The coupling element 24 in the form of the traction cable is firmly connected to the transmission element 20 via a first end 240 in the region of the end 200 of the transmission element 20. A second end 241 of the coupling element 24 on the other hand is connected to the end 201 of the transmission element 20 via a tensioning device 242. Via the tensioning device 242, the tension of the coupling element 24 can be set at the transmission element 20.

Figure 2:
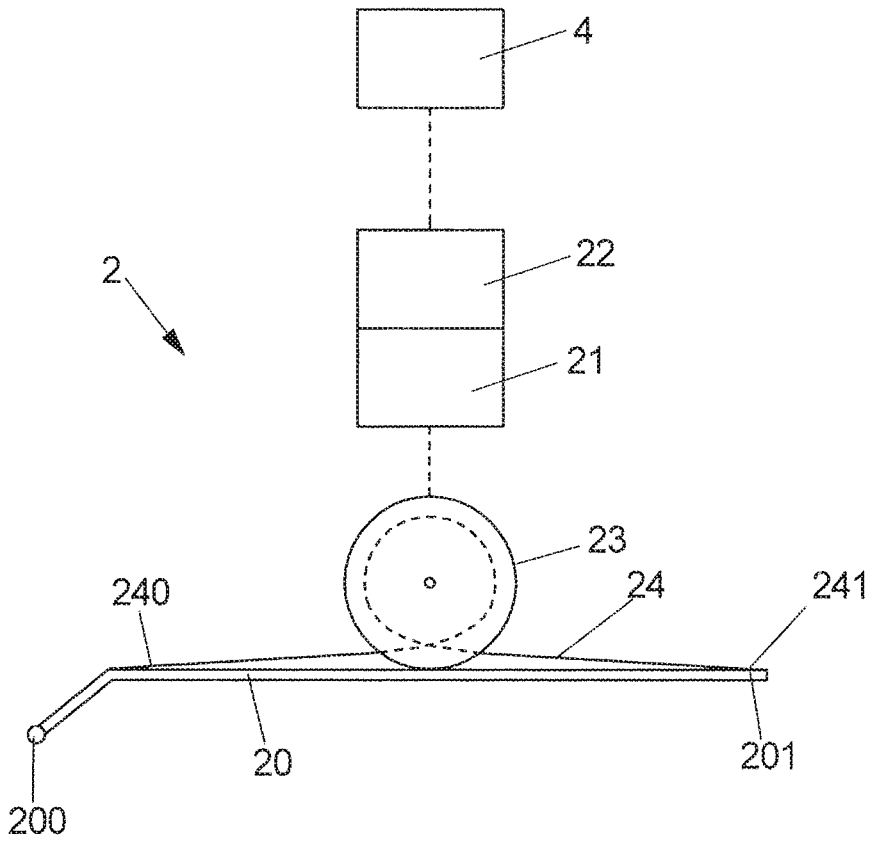
FIG. 2 shows a schematic view of a force-transmitting device in the form of a door drive with a drive motor, a coupling device, a control device and a transmission element for the power transmission for adjusting the vehicle door.

As schematically shown in FIG. 2, the operation of the drive motor 22 is controlled via a control device 4, which for example, as indicated in FIG. 1, can be arranged on an assembly carrier of a door module 112 of the vehicle door 11. Such an assembly carrier for example can carry different functional components of the vehicle door 11, for example a window lifter device, a loudspeaker, a door lock or the like. In this connection, the control device 4 can serve for controlling the force-transmitting device 2, but in addition also for controlling other functional components of the vehicle door 11.

The force-transmitting device 2, as it has been explained above with reference to FIGS. 1 to 5, on the one hand serves for electromotively adjusting the vehicle door 11 and on the other hand for fixing the vehicle door 11 in an open position. In a holding position, the coupling device 21 is in its coupling condition and thereby produces a flux of force between the vehicle door 11 and the vehicle body 10 so that—e.g. due to self-locking at the transmission 25 and/or the drive motor 22—the vehicle door 11 is held in its open position. When it has been brought into an open position, the vehicle door 11 thus cannot easily move out of the open position in an uncontrolled way.

It is desirable to enable a user to adjust the vehicle door 11 in a simple way. For this purpose it may be recognized when a user touches the vehicle door 11 in order to close the vehicle door 11 for example out of the open position or open it further in the opening direction θ. When a user applies a force to the vehicle door 11, for example by pushing or pulling the vehicle door 11, this shall be recognized as a wish for adjustment in order to initiate an electromotive adjustment of the vehicle door 11 depending thereon or to permit a manual adjustment of the vehicle door 11 by the user.

To recognize such a user's wish for adjustment, a sensor device 30 in the form of an acceleration sensor or a gyrosensor for example can be arranged on the vehicle door 11, as this is schematically shown in FIG. 1. Via such a sensor device 30, an acceleration/movement at the vehicle door 11 thus can be inferred directly and with little time delay in order to therefrom draw conclusions as to a possible user's wish for adjustment.

This makes use of the fact that in the adjustment system of the vehicle door 11, i.e. in the force-transmitting device 2 just like in the vehicle door 11 itself, a system slack and a system elasticity in principle are present, due to which a (slight) movement of the vehicle door 11 is possible also with a fixed vehicle door 11. When a user thus touches the vehicle door 11, this leads to a (slight) movement of the vehicle door 11 and thus to an acceleration of the vehicle door 11, which is recognized by an acceleration sensor or a gyrosensor and can be evaluated correspondingly.

An acceleration sensor may measure the acceleration of the vehicle door 11. When the vehicle door 11 is accelerated out of a standing position—by the touch of a user who for example pushes the door in order to adjust the door—, this leads to an acceleration signal at the sensor device 30 configured as an acceleration sensor. When the acceleration is greater in amount than a threshold value or when it is equal to a predetermined profile, it can be inferred therefrom that a wish for adjustment exists so that an adjusting operation of the vehicle door 11 can be initiated and the drive motor 22 can be actuated correspondingly.

A sensor device 30 configured as a gyrosensor on the other hand measures the angular velocity, i.e. the swivel movement of the vehicle door 11. From the angular velocity a movement at the vehicle door 11 can be recognized in order to thereby recognize a user's wish for adjustment, and possibly an electromotive adjusting operation can be initiated.

The sensor device 30 in the form of the acceleration sensor or the gyrosensor is stationarily arranged for example on an assembly carrier of a door module 112. The sensor device 30 can be configured as a separate assembly and be arranged on the assembly carrier. It is also conceivable and possible, however, to form the sensor device 30 in a chip and integrate the same into the control device 4.

When a user touches the vehicle door 11, a movement of the vehicle door is effected in connection with a system slack (a system play) and in connection with a system elasticity. Even if the coupling device is in its coupling condition, the vehicle door 11 can at least slightly be moved when touched by a user, for example when the vehicle door 11 is pushed or pulled. When the sensor device 30 is configured as an acceleration sensor or as a gyrosensor, this (slight) movement at the vehicle door 11 can be recognized and, for example when a corresponding sensor signal exceeds a predetermined threshold value, a user's wish for adjustment can be inferred therefrom.

In an alternative embodiment, there can also be provided a sensor device 31-33 that generates a sensor signal from which a force in the flux of force between the vehicle door 11 and the vehicle body 10 can be inferred (in this text, such a sensor device shall be referred to as "force sensor").

In a first variant, as is schematically shown in FIG. 4, such a sensor device 31 in the form of a force sensor can be arranged for example on the tensioning device 242 in order to measure a force applied to the coupling element 24. When it is recognized that the force on the coupling element 24 rises, a possible user's wish for adjustment can be inferred therefrom.

In a second variant, a sensor device 32 can recognize and measure a torsion of the shaft 26. For this purpose, an inductive or capacitive sensor module 321 for example can determine the distance to an eccentric disk 320. When a force acts on the vehicle door 11 with a closed coupling device 21, for example because a user pushes the vehicle door 11 to adjust the same, this leads to a (slight) torsion of the shaft 26 that can be measured by the sensor device 32, so that a corresponding sensor signal can be evaluated in order to calculate the applied force from the measured torsion, and when the force exceeds a predetermined threshold value, infer a user's wish for adjustment.

Analogously, in a third variant a sensor device 33 can also be arranged in the region of the drive element 23 in the form of the cable drum in order to infer a torsion of shaft 26 with reference to a rotation of the drive element 23 or an element arranged on the shaft 26 in the region of the drive element 23.

Figure 6:
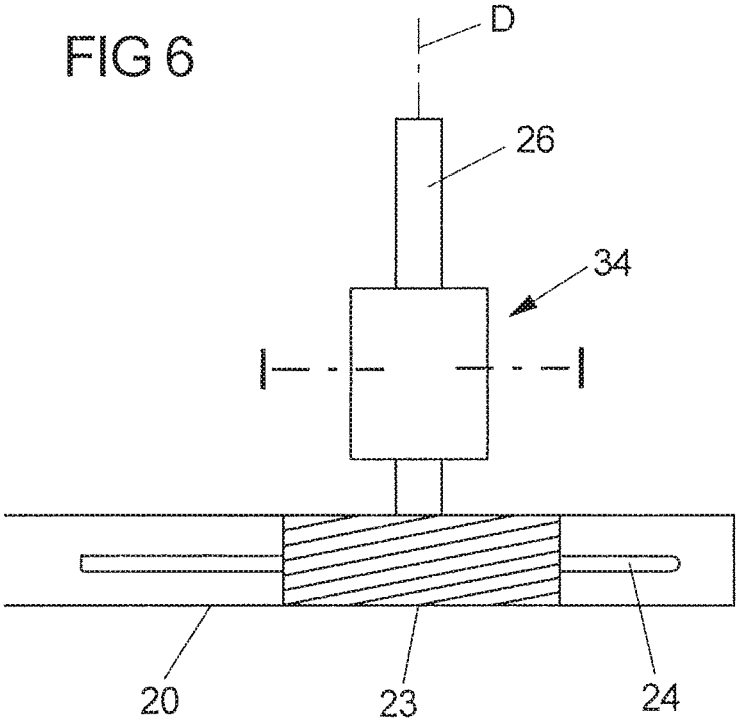
FIG. 6 shows a schematic view of a sub-assembly of the force-transmitting device in the form of the door drive, comprising a magnetic field sensor arranged on a shaft for measuring a magnetic field at the shaft.

In an exemplary embodiment illustrated in FIGS. 6 and 7, a sensor device 34 in the form of a force sensor formed by a magnetic field sensor is arranged on the shaft 26 for measuring a torsion on the shaft 26.

As shown in FIGS. 7A to 7D, the shaft 26 includes magnetic portions 260, 261 on which the shaft 26 is magnetized to form magnetic tracks.

Figure 7A:
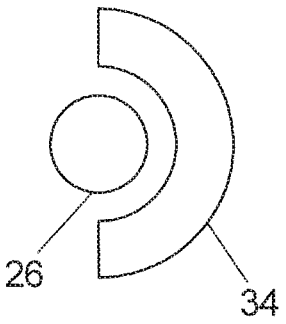
FIG. 7A shows a schematic cross-sectional view along the line I-I according to FIG. 6.
Figure 7B:
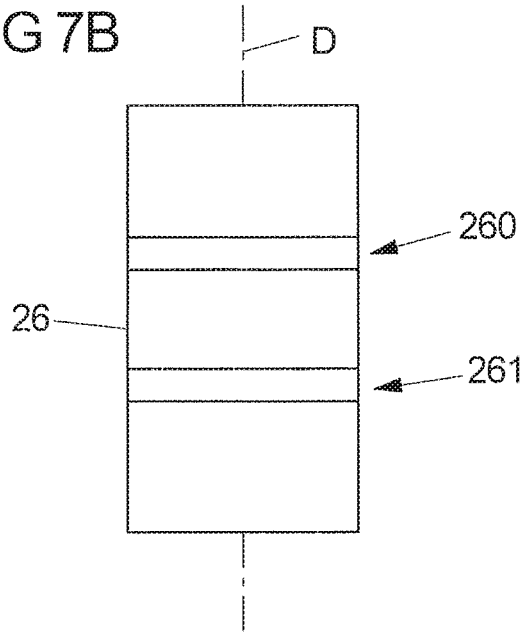
FIG. 7B shows a schematic view of the shaft with magnetic portions arranged thereon in the form of magnetic tracks.
Figure 7C:
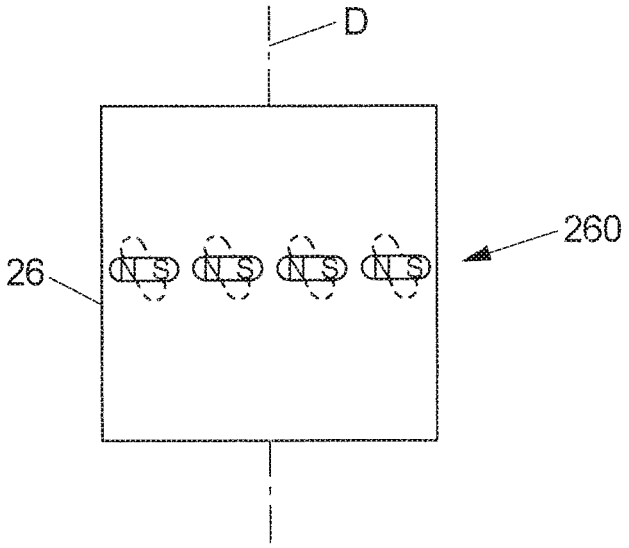
FIG. 7C shows a schematic representation of an exemplary embodiment for realizing a magnetic track.
Figure 7D:
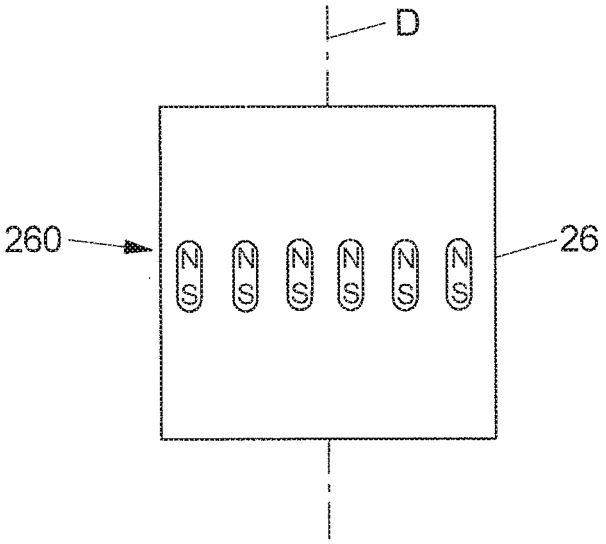
FIG. 7D shows a schematic representation of another exemplary embodiment for realizing a magnetic track.

As this is shown in FIGS. 7B to 7D, a plurality of magnetic tracks 260, 261 each with a plurality of north poles N and south poles S can circumferentially be impressed around the shaft. The magnetic tracks 260, 261, which realize magnetic portions on the shaft 26, here extend around the shaft 26 (i.e. circumferentially around the axis of rotation D) and thus revolve around the shaft 26.

Each magnetic track 260, 261 may be formed by a plurality of pairs of magnetic poles, each consisting of a north pole N and a south pole S.

In the exemplary embodiment according to FIG. 7C, the pairs of magnetic poles are circumferentially lined up side by side so that, as seen in circumferential direction around the axis of rotation D, a north pole N of a pair of magnetic poles is adjoined by a south pole S of another pair of magnetic poles, etc.

In the exemplary embodiment according to FIG. 7D the pairs of magnetic poles on the other hand each are aligned parallel to the axis of rotation D and circumferentially arranged one beside the other and lined up side by side.

When the shaft 26 is twisted due to a torque acting on the shaft 26 by action of a force on the vehicle door 11, this leads to a change in the magnetic field on the shaft 26. This change can be detected by the magnetic field sensor 34, which correspondingly produces a sensor signal in dependence on the magnitude of the change.

As long as no torsion acts on the shaft, the magnetic field of the magnetic tracks 260, 261 is circumferentially symmetrical and hence quasi-magnetically short-circuited. As soon as a torsion occurs on the shaft, the pairs of magnetic poles are tilted (as is schematically illustrated in FIG. 7C) and a magnetic field emerges from the shaft, which can be measured by the sensor device 34.

A torsion of the shaft 26 may be sensitively recognized and measured with reference to a change in the magnetic field on the shaft 26 by the sensor device 34.

In the illustrated exemplary embodiment the magnetic field sensor 34 extends halfway around the shaft 26 and therefor has the shape of a half-ring (semicircular doughnut).

Figure 8:
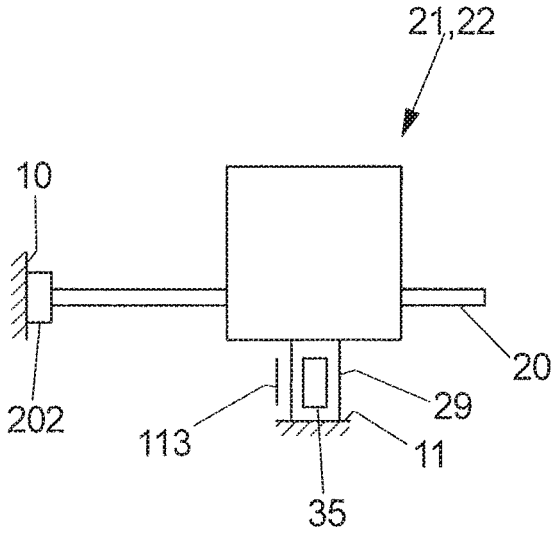
FIG. 8 shows a schematic view of a sub-assembly of the force-transmitting device in the form of the door drive comprising an inductive sensor arranged on a mount of the force-transmitting device for measuring a deformation at the mount.

In another exemplary embodiment shown in FIG. 8, a sensor device 35 in the form of a force sensor formed by an inductive sensor is arranged on a mount 29 of the force-transmitting device 2. Via the mount 29, the force-transmitting device 2 is attached to the vehicle door 11.

The mount 29 as such constitutes a rigid component which however can be (slightly) deformed by action of a (large) force in the flux of force between the vehicle door 11 and the vehicle body 10, which can be measured by measuring the distance between a portion of the mount 29 and a portion 113 of the vehicle door 11 (or another portion of the mount 29) by using the inductive sensor 35. A deformation at the mount 29 may be detected by the inductive sensor 35 to infer a force in the flux of force between the vehicle door 11 and the vehicle body 10, resulting from a force at the vehicle door 11 (with fixed vehicle door 11).

Figure 9A:
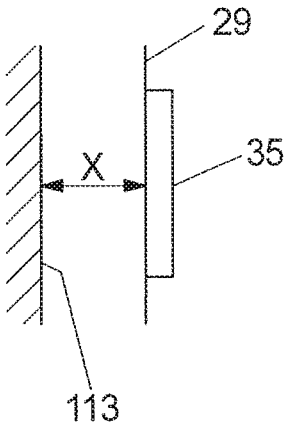
FIG. 9A shows a schematic view of the inductive sensor disposed opposite a portion, wherein a deformation can be measured with reference to a change in distance between the inductive sensor and the portion.

As schematically shown in FIG. 9A, the sensor device 35 in the form of the inductive sensor is disposed opposite a portion 113 that for example can be part of the vehicle door 11 or also of the mount 29. The inductive sensor 35 provides for measuring a distance X between the inductive sensor 35 and the portion 113 so that a deformation that is accompanied by a change in distance between the inductive sensor 35 and the portion 113 can be determined and measured.

The portion 113 can be formed on the vehicle door 11 separate from the mount 29 and is electrically conductive so that it can electrically cooperate with the inductive sensor 35. Alternatively, the portion 113 can also be part of the mount 29 so that the inductive sensor 35 measures a deformation between different portions of the mount 29.

Figure 9B:
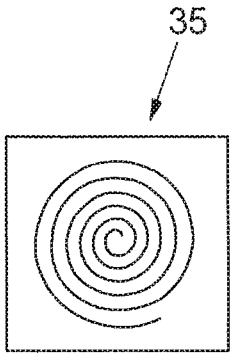
FIG. 9B shows a schematic view of an inductive sensor with a sensor coil.

As schematically shown in FIG. 9B, an inductive sensor for example can include a sensor coil that is disposed opposite a conductive portion of the stationary portion 113. When the distance between the sensor coil and the conductive portion changes, this can be recognized due to an inductive interaction in a sensor signal of the inductive sensor.

Figure 10:
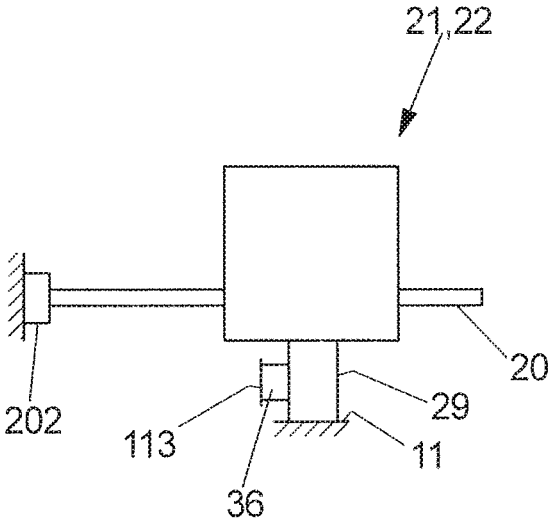
FIG. 10 shows a schematic view of a sub-assembly of the force-transmitting device in the form of the door drive comprising a piezosensor arranged on a mount of the force-transmitting device for measuring a deformation at the mount.

In an exemplary embodiment shown in FIG. 10, a piezosensor 36 is arranged between the mount 29 and the stationary portion 113 of the vehicle door 11 and connected both to the mount 29 and to the portion 113. When there is a relative movement between the mount 29 and the stationary portion 113 due to the action of a force on the vehicle door 11, this leads to a corresponding action of force on the sensor 36 and correspondingly to a sensor signal that can be evaluated to recognize a wish for adjustment.

Figure 11:
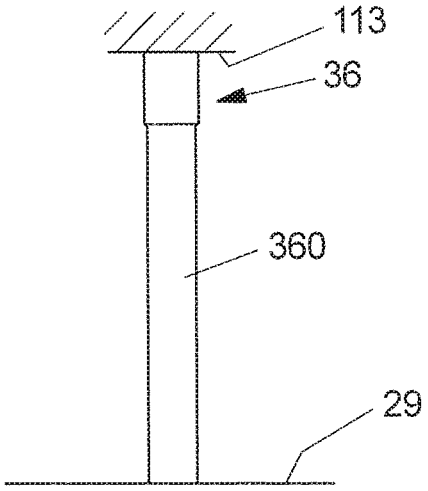
FIG. 11 shows a schematic view of the piezosensor at a connecting portion between a mount and a stationary portion.

As schematically shown in FIG. 11, the sensor device 36 in the form of the piezosensor for example can be connected to the mount 29 via a (slightly elastically) deformable connecting portion 360 in the manner of a cantilever arm and thus be coupled to the mount 29 via the connecting portion 360. The sensor device 36 also is connected to the portion 113 so that the piezosensor 36 is held between the connecting portion 160 and the portion 113. When a deformation occurs at the mount 29, this also leads to a deformation of the connecting portion 360 and hence to the action of a force on the piezosensor 36, which can be detected and measured.

The portion 113 in turn can be part of the vehicle door 11. Alternatively, it is also conceivable that the portion 113 is part of the mount 29 so that a deformation on the mount 29 may be measured the piezosensor 36.

Due to the fact that a sensor device 31-36 is arranged in the flux of force before the drive motor 42, the sensor device 31-36 generates a sensor signal that can indicate a wish for adjustment reliably and with little time delay. By evaluating such a sensor signal that indicates the force in the flux of force at a place before the drive motor 42, a wish for adjustment can thus be inferred.

Depending on its configuration, the sensor device 30-36 produces a sensor signal that is proportional to the acceleration of the vehicle door 11, the angular velocity of the vehicle door 11 or a force acting on the vehicle door 11. In an open position the vehicle door 11 is fixed with a closed coupling device 21 (which correspondingly is in its coupling condition) so that a user touching the vehicle door 11 leads to a (slight) acceleration and hence movement at the vehicle door 11 (which can be recognized by a sensor device 30 in the form of an acceleration sensor or a gyrosensor) and due to the closed flux of force leads to a tension in the force-transmitting device 2 (which can be recognized by a sensor device 31-36 in the form of a force sensor).

When a sensor signal is obtained at the sensor device 30-36 due to an acceleration/movement of the vehicle door 11 or a force on the vehicle door 11, this can be compared with a predetermined threshold value or a predetermined signal profile. Depending on the configuration of the sensor device 30-36 the threshold value here represents an acceleration threshold value, a velocity threshold value or a force threshold value, upon exceedance of which a user's wish for adjustment is recognized.

When a user's wish for adjustment is recognized, the control device 4 can be configured in a different way in order to initiate an adjustment of the vehicle door 11 in an electromotive way or to provide for a manual adjustment of the vehicle door 11.

When the vehicle door 11 is to be adjusted electromotively upon recognition of a wish for adjustment, the control device 4 actuates the drive motor 22 for electromotively adjusting the vehicle door 11 upon recognition of a wish for adjustment. In this case, the coupling device 21 remains in its closed (coupling) condition.

On the other hand, when the vehicle door 11 is to be manually adjusted upon recognition of a wish for adjustment, the control device 4 actuates the coupling device 21 for transferring from the coupling condition into the decoupling condition upon recognition of a wish for adjustment, so that the flux of force between the vehicle door 11 and the vehicle body 10 is interrupted and the vehicle door 11 correspondingly can be manually adjusted.

The sensor devices 30-36 can each be used separately. It is also conceivable and possible, however, to use the sensor devices 30-36 in combination with each other. Depending on the configuration of the sensor devices 30-36, different threshold values can be used.

Sensor signals of the sensor device 30-36 can be evaluated alone in order to infer a wish for adjustment from these sensor signals. It is also conceivable and possible, however, to combine an evaluation of sensor signals of different sensor devices 30-36 in order to provide for a particularly reliable recognition of a wish for adjustment.

The idea underlying the proposed solution is not limited to the exemplary embodiments described above, but can also be realized in principle in a completely different way.

A door drive in particular can also include a different adjusting mechanism, for example in that the drive motor cooperates with a transmission element by engagement of a pinion. Alternatively, however, the door drive can also be configured e.g. as a spindle drive in which e.g. a spindle is rotated and is in engagement with a spindle nut, so that the spindle nut is shifted along the spindle due to the rotary movement of the spindle.

In the case of a pure fixing device a drive motor can also be omitted in principle.

LIST OF REFERENCE NUMERALS

1 vehicle
10 stationary portion (vehicle body)
100 vehicle opening
11 vehicle door
110 door interior space
111 door joint
112 door module
113 portion
2 force-transmitting device
20 transmission element (catch strap)
200, 201 end
202 joint
21 coupling device
210 actuating drive
22 drive motor
220 motor shaft
23 drive element
24 coupling element (traction cable)
240, 241 end
242 tensioning device
25 transmission
26 shaft
260, 261 magnetic portions
27 sensor device
28 door module
29 mounting device
30-36 sensor device
320 eccentric disk
321 sensor module
360 connecting portion
4 control device
D axis of rotation
O opening direction
X distance

The invention claimed is:

1. A vehicle door assembly, comprising:
a vehicle door pivotally arranged on a vehicle body;
a force-transmitting device configured to adjust and selectively fix the vehicle door relative to the vehicle body, wherein the force-transmitting device includes,
a transmission element, configured to establish a flux of force between the vehicle door and the vehicle body in order to adjust the vehicle door relative to the vehicle body or hold it in position relative to the vehicle body, and
a drive shaft coupled to the transmission element and including at least one magnetic portion;
at least one sensor device including a force sensor arranged in the flux of force between the vehicle door and the vehicle body and configured to measure a magnetic field produced by the at least one magnetic portion of the drive shaft, wherein the magnetic field is indicative of torsion applied to driveshaft; and
a control device for controlling the force-transmitting device and configured to evaluate a sensor signal of the at least one sensor device to identify a user command for adjusting the vehicle door, wherein the control device is further configured to actuate the force-transmitting device based on the evaluation to enable adjustment of the vehicle door.

2. The vehicle door assembly of claim 1, wherein the force-transmitting device includes an electrically actuatable coupling device which in a coupling, first condition couples a drive motor to the transmission element in order to exert an adjusting force for adjusting the vehicle door on the transmission element, and in a decoupling, second condition decouples the drive motor from the transmission element.

3. The vehicle door assembly of claim 2, wherein in a holding position of the vehicle door the coupling device is in the coupling, first condition in order to fix the vehicle door relative to the vehicle body.

4. The vehicle door assembly of claim 3, wherein the control device is configured to actuate the coupling device upon recognition of user's wish for adjustment for transferring from the coupling, first condition into the decoupling, second condition.

5. The vehicle door assembly of claim 1, wherein the force-transmitting device includes a drive motor for electromotively adjusting the vehicle door, wherein the control device is configured to actuate the drive motor upon recognition of a user's wish for adjustment for electromotively adjusting the vehicle door.

6. The vehicle door assembly of claim 5, wherein the drive motor is stationarily arranged on the vehicle door and the transmission element is articulated to the vehicle body.

7. The vehicle door assembly of claim 1, wherein the drive shaft is coupled to the transmission element via a flexible coupling element configured for the transmission of tensile forces.

8. The vehicle door assembly of claim 7, wherein a sensor device in the form of a force sensor is arranged on the transmission element for measuring a force on the coupling element.

9. The vehicle door assembly of claim 8, wherein the sensor device in the form of the force sensor is arranged on a tensioning device for tensioning the coupling element relative to the transmission element.

10. A vehicle door assembly comprising:

a vehicle door pivotally arranged on a vehicle body;

a force-transmitting device configured to adjust and selectively fix the vehicle door relative to the vehicle body, wherein the force-transmitting device includes, a stationary portion, and a transmission element configured to establish a flux of force between the vehicle door and the vehicle body in order to adjust the vehicle door relative to the vehicle body or hold it in position relative to the vehicle body;

at least one sensor device including a force sensor arranged in the flux of force between the vehicle door and the vehicle body and configured to measure deformation of the stationary portion; and a control device for controlling the force-transmitting device and configured to evaluate a sensor signal of the at least one sensor device for identifying a user command for adjusting the vehicle door, wherein the control device is further configured to actuate the force-transmitting device based on the evaluation to enable adjustment of the vehicle door.

11. The vehicle door assembly of claim 10, wherein the force sensor is disposed on the stationary portion.

12. The vehicle door assembly of claim 10, wherein the force sensor is an inductive sensor or as a piezosensor.

* * * * *